United States Patent [19]

Lichtblau

[11] Patent Number: 4,779,077

[45] Date of Patent: Oct. 18, 1988

[54] CONTINUOUSLY ARMED HIGH RELIABILITY PULSE TRAIN PROCESSOR

[76] Inventor: George J. Lichtblau, 23 Pin Pack Rd., Ridgefield, Conn. 06877

[21] Appl. No.: 37,647

[22] Filed: Apr. 13, 1987

[51] Int. Cl.[4] ..... G08B 13/24

[52] U.S. Cl. ..... 340/572; 340/551

[58] Field of Search ..... 340/572, 551, 659, 523, 340/825.57, 825.59, 825.63, 825.64, 825.31, 825.34; 342/27; 375/75, 94

[56] References Cited

U.S. PATENT DOCUMENTS

| | | | |
|---|---|---|---|
| 3,810,147 | 5/1974 | Lichtblau | 340/572 |
| 3,828,337 | 8/1974 | Lichtblau | 340/572 |
| 3,863,244 | 1/1975 | Lichtblau | 340/572 |
| 3,913,219 | 10/1974 | Lichtblau | 361/402 |
| 3,938,044 | 2/1976 | Lichtblau | 340/572 |
| 3,961,322 | 6/1976 | Lichtblau | 340/572 X |
| 3,967,161 | 6/1976 | Lichtblau | 340/572 |
| 4,021,705 | 5/1977 | Lichtblau | 361/402 |
| 4,117,466 | 9/1978 | Lichtblau | 340/501 |
| 4,168,496 | 9/1979 | Lichtblau | 340/572 |
| 4,243,980 | 1/1981 | Lichtblau | 340/572 |
| 4,251,808 | 2/1981 | Lichtblau | 340/572 |
| 4,260,990 | 4/1981 | Lichtblau | 343/742 |
| 4,498,076 | 2/1985 | Lichtblau | 340/572 |
| 4,567,473 | 1/1086 | Lichtblau | 340/572 |

*Primary Examiner*—Glen R. Swann, III
*Assistant Examiner*—Thomas J. Mullen, Jr.
*Attorney, Agent, or Firm*—Weingarten, Schurgin, Gagnebin & Hayes

[57] ABSTRACT

A pulse train processor includes a plurality of parallel input, serially coupled pulse discriminating modules one for each of the consecutive pulses of a pulse train characteristic of a magnetic strip or resonant tag target signal produced in a magnetic interrogation zone such as found in retail clothing or library theft prevention applications. Each module is tailored to the particular expected characteristics of the corresponding pulse of the pulse train, and the modules are serially enabled and an alarm is triggered if and only if the expected characteristics of the several pulses are sequentially present from the initial pulse to the last pulse of the received pulse train. The modules are self-resetting in the event that the pulse characteristics of any of the pulses are other than the expected pulse characteristics whereby the pulse train processor is substantially continuously armed. The modules are responsive to pulse sequence, pulse polarity, pulse height, and minimum and maximum duration of the several constitutive pulses of the pulse train whereby an ultra-high detection reliability is provided.

27 Claims, 4 Drawing Sheets

CONTINUOUSLY ARMED HIGH RELIABILITY PULSE TRAIN PROCESSOR

FIELD OF THE INVENTION

The present invention is directed to the field of noise rejection circuitry, and more particularly, to a continuously armed, highly reliable, pulse train processor especially for magnetic strip and resonant tag signal detection.

BACKGROUND OF THE INVENTION

Magnetic and swept frequency systems, components and subsystems are disclosed in U.S. Pat. Nos. 3,810,147, 3,828,337, 3,863,244, 3,913,219, 3,938,044, 3,961,322, 3,967,161, 4,021,705, 4,117,466, 4,168,496, 4,243,980, 4,251,808, 4,260,990, 4,498,076, 4,567,473, and in Canadian Pat. No. 1005546, of the same inventive entity as herein, each being incorporated herein by reference. U.S. Pat. No. 3,961,322 discloses receiver circuitry operative to distinguish an interrogation signal in the form of an interrogation signal pulse train from environmental and other spurious signals. In response to the pulse height of the initial pulse of the received pulse train, the therein disclosed receiver circuitry starts a counter. The counter with each increment enables a sequential pulse discrimination module until it cycles through a predetermined time sequence that sequentially enables all of the pulse discrimination modules. The prior system, however, cannot be reset until after the entire cycle has been gone through, so that during this whole time, the prior system is locked-up, and is subjected to an undesirable failure of alarm situation. Moreover, each pulse discrimination module of the prior system is limited with respect to the capability that it is able to discriminate the characteristics of the pulses, such that if the pulses meet predetermined merely minimum duration conditions, the disclosed receiver circuitry produces an alarm, notwithstanding that the pulses may later exhibit totally unexpected characteristics typically representative of noise, so that the prior system is thereby subjected to an undesirable false alarm situation.

SUMMARY OF THE INVENTION

The present invention contemplates as one of its objects the provision of a pulse train processor capable of processing the several constitutive consecutive pulses of a magnetic system pulse train in such a way that the processing occurs without locking-up the system after processing of an initial pulse is initiated so that the system is substantially continuously armed.

In general terms, the present invention accomplishes this object by providing a pulse train processor operative to discriminate the constitutive pulses of the received pulse train with respect to whether they severally satisfy certain expected characteristics in such a way that if any of the pulses fails to satisfy its corresponding expected characteristics, the processor resets itself immediately, without having to first complete any timing cycle.

The present invention contemplates as another object a pulse train processor that discriminates the several constitutive pulses with respect to both minimum as well as maximum conditions, and that provides an output alarm if the pulses severally satisfy the minimum conditions and only if they do not exceed the maximum conditions whereby a high reliability of output alarm signaling is substantially ensured.

The present invention accomplishes this object by providing a pulse train processor that is responsive to both the minimum duration and to the maximum duration of each of the several pulses, and alarms if and only if each of the pulses is within its respective minimum and maximum bounds and the several pulses occur in their proper time sequence.

DESCRIPTION OF THE DRAWINGS

These and other objects, aspects, and advantages of the present invention will become apparent as the invention becomes better understood by referring to the following non-limiting and solely exemplary detailed description of the preferred embodiment thereof, and to the drawings wherein.

DETAILED DESCRIPTION OF THE PREFERRED EMBODIMENT

Figure 1:
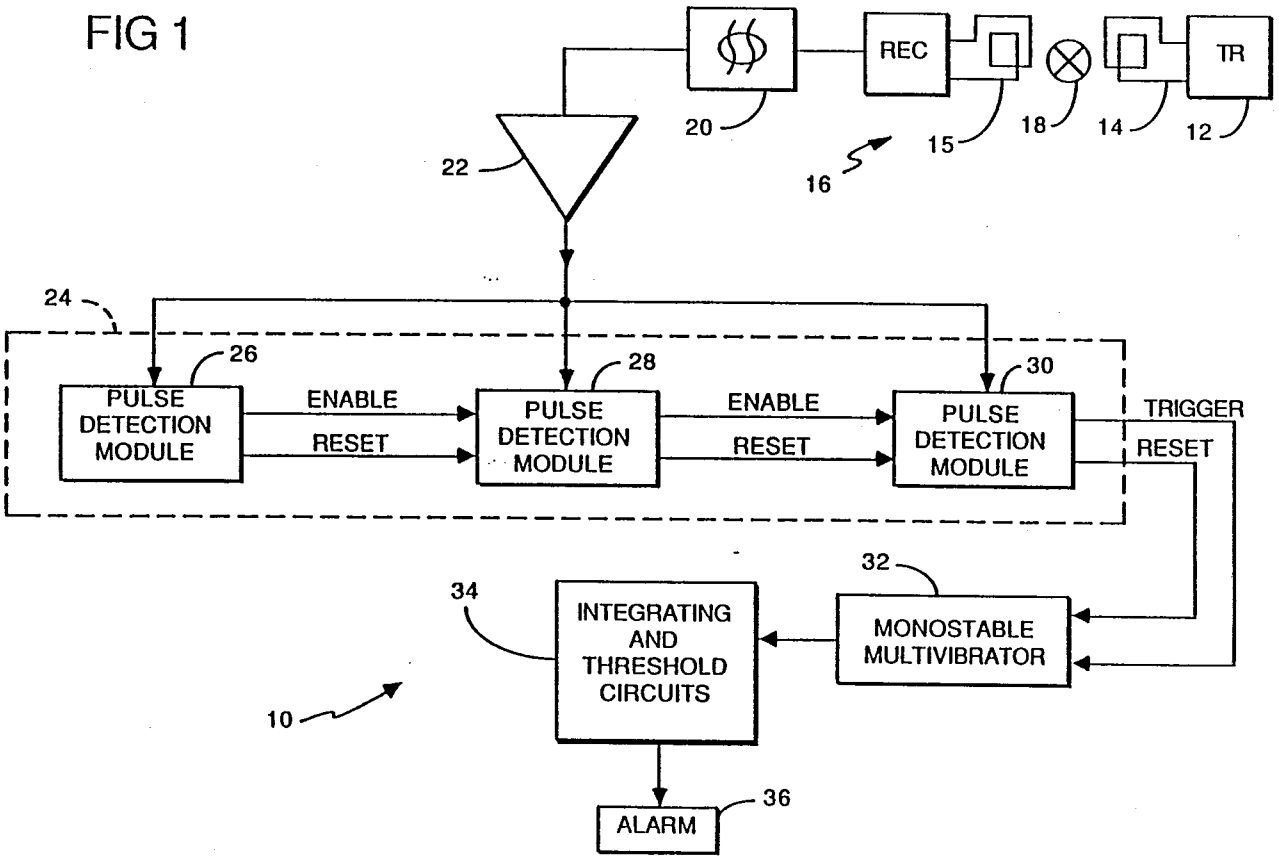
FIG. 1 is a block diagram illustrating the novel continuously armed high reliability pulse train processor in an exemplary magnetic and/or resonant interrogation receiver application according to the present invention.

Referring now to FIG. 1, generally designated at 10 is a block diagram of the continuously armed, high reliability pulse train processor in an exemplary magnetic and resonant interrogation system receiver application according to the present invention. In this application, the present invention has its utility in discriminating true signal from noise in a field disturbance responsive receiver sensitive to the movement of a marked tag through an interrogation zone to provide an alarm representative of shoplifting and other unlawful taking in retail stores, libraries and the like. A transmitter generally designated 12 drives an antenna 14 which generates either a low-frequency or a radio frequency magnetic field in a specific area called the "interrogation zone". Normally, but not necessarily, a second and separate antenna 15 connected to a receiver generally designated 16 is responsive to changes in the magnetic field caused by a so-called target 18 schematically illustrated by a circle with a "X" therethrough. In a system which uses a low-frequency magnetic field, the target is typically a high permeability magnetic strip which saturates abruptly as compared to the period of the changing magnetic field. In a system which uses a radio frequency magnetic field, the interrogation signal consists of a radio frequency signal which is frequency modulated approximately five to ten percent of the center frequency. In this latter system, the target is a resonant circuit tuned to be near the center frequency of the interrogation signal. Each time that the frequency of the interrogation signal passes through the resonant frequency of the target, an abrupt change takes place in the magnetic field.

The signal induced by the abrupt change in the magnetic field is sensed by the receiver antenna 15, is demodulated by the receiver 16, filtered in a band-pass filter 20 to remove noise, and amplified in an amplifier 22. Thereafter, the signal is fed in parallel into the pulse train processor 24 to be described of the present invention.

The pulse train processor 24 is operative to distinguish true target signals from noise, and in such a way as to be both substantially continuously armed and to provide a very high confidence detection signal.

In terms of the later, the pulse train processor is operative to produce an output trigger pulse if each of the pulses of the pulse train have a height above a predetermined threshold that severally exist during selected but precisely defined time windows and only if the several pulses occur in a predetermined polarity sequence. A first necessary but not sufficient criteria that must be satisfied if the processor 24 is to produce an output trigger pulse representative of a true signal is that the received pulses as produced by the tag being in the interrogation zone or otherwise arising must correspond to an expected polarity sequence of an ideal pulse train. For an exemplary resonant circuit based interrogation system, such an expected polarity sequence is, on the one hand, a succession of a positive a negative and a positive pulse, and on the other hand, a succession of a negative a positive and a negative pulse. The pulse train processor 24 does not produce the output trigger pulse if the received pulse train does not conform to the expected polarity sequence.

The pulse train processor includes a plurality of pulse processing modules each dedicated to corresponding ones of the expected pulses of the ideal pulse train. In the illustrated embodiment, three pulse processing modules 26, 28, and 30 are disclosed, although a different number of pulse processing modules are possible in accordance with the number of pulses expected to be produced in the particular control system, one pulse processing module being dedicated to the expected characteristics of each of the several pulses of the ideal pulse train.

The several modules 26, 28, 30 are respectively dedicated to the constitutive pulses of the exemplary tertiary pulse ideal pulse train. In accordance with a second necessary but alone not sufficient condition, each of the received pulses must meet predetermined minimum, maximum, and threshold criteria if the pulse train processor is to produce an output trigger pulse. Each module 26, 28, 30 is operative to detect whether the corresponding pulse exceeds a predetermined pulse height threshold for a time longer than a predetermined first time but not longer than a predetermined second time. But if the corresponding pulse processing modules are not satisfied that the corresponding pulses conform to these very accurate several criteria, the pulse train processor rejects the received pulses as spurious, and false alarms are thereby substantially prevented.

The pulse train processor is substantially continuously armed, and no timers or other sequencing devices lock out system responsiveness. If the characteristics of the first received pulse of the pulse train correspond to the expected characteristics thereof, the module 26 is operative to enable the module 28. But if the characteristics of that pulse do not correspond to the expected characteristics of the pulse, the module 26 does not enable but rather resets the module 28, and the processor is therewith returned to its armed state. The module 26, in the preferred embodiment, is always enabled. Similarly, the module 28, assuming it was enabled by the upstream module 26, is operative to determine whether the next pulse of the received pulse train has characteristics that correspond to the expected characteristics associated with that pulse in the ideal pulse train. In the event that the pulse does have the requisite pulse characteristics, the pulse module 28 enables the downstream pulse detection module 30. But, again, if the characteristics of the pulse corresponding to the second pulse of the pulse train fail to correspond to the expected characteristics, the module 30 is not enabled but is reset, and the processor is again returned to its armed state. Each module, further, is self-resetting at the termination of the corresponding pulse, as described more fully below.

If the several modules 26, 28, 30 detect the expected characteristics of the corresponding pulses of the pulse train in the correct temporal polarity sequence, the module 30 provides an output trigger pulse signaling detection of a pulse train representative of a tag being present in the interrogation zone.

A monostable multivibrator 32 is connected to the output module of the pulse train processor 24. The monostable multivibrator 32 produces a pulse in response to each trigger signal out of the pulse train processor. The monostable multivibrator 32 may be part of a missing pulse detector described in U.S. Pat. No. 3,828,337 of the same inventive entity as herein, incorporated herein by reference.

An integrating and threshold circuit 34 to be described is connected to the output of the multivibrator 32.

Figure 2:
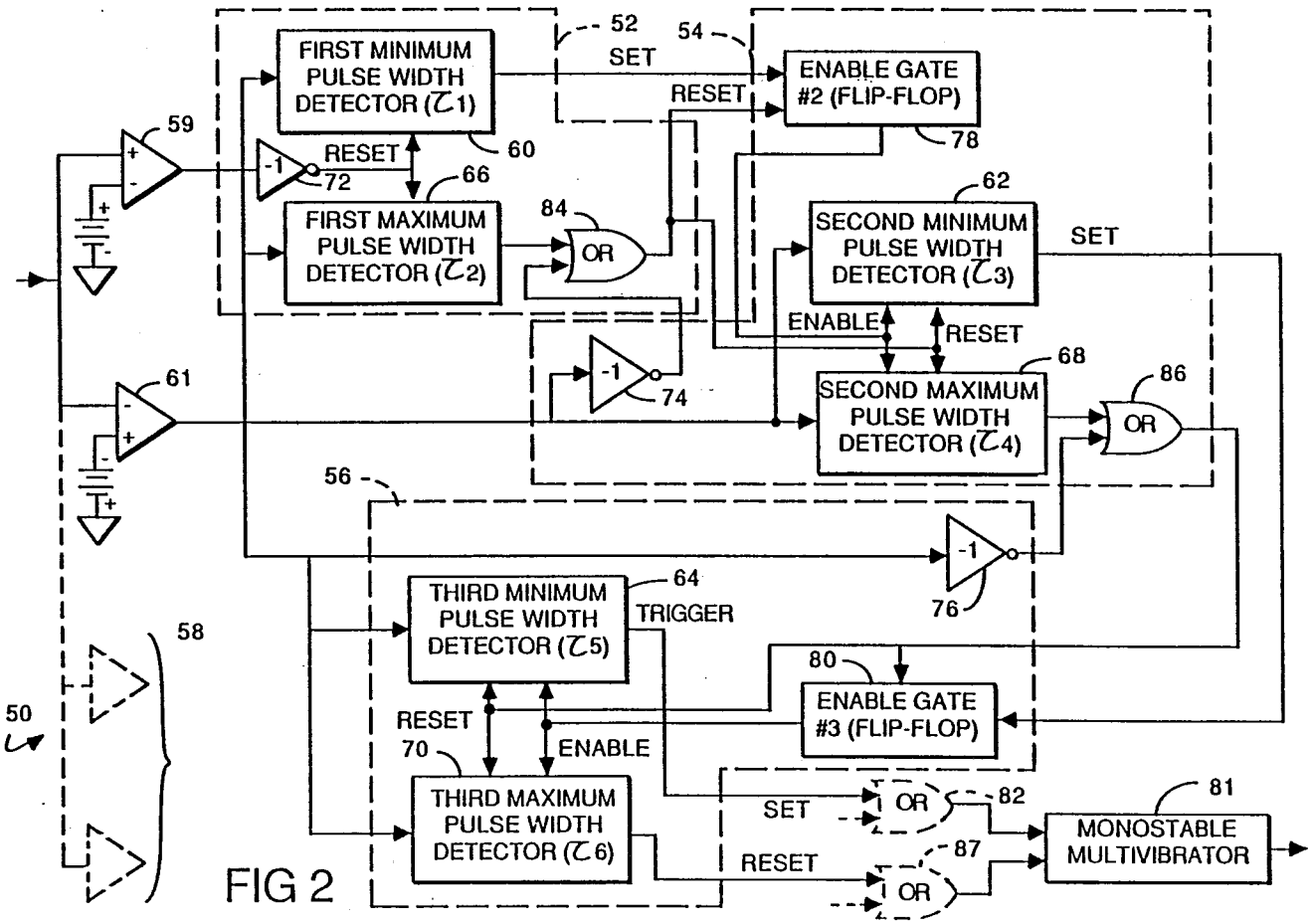
FIG. 2 is a detailed schematic diagram of the pulse train processor of the present invention.

Referring now to FIG. 2, generally designated at 50 is a schematic diagram illustrating the continuously armed, high reliability pulse train processor according to the present invention. The processor 50 includes three pulse processing modules illustrated in dashed outline 52, 54, and 56. The modules 52, 54, 56 are dedicated to a positive pulse, a negative pulse and a positive pulse defining an expected pulse train sequence. The positive, negative, positive pulse three pulse pulse train is exemplary only. As illustrated by a bracket 58, another bank of pulse processing modules, not specifically illustrated, may be employed for a three pulse pulse train having a negative, positive, and a negative pulse polarity sequence. The principles of the instant invention, of course, can be employed with other numbers of constitutive pulses of an expedited pulse train with a different expected polarity sequence without departing from the inventive concept.

A positive threshold detector 59 and a negative threshold detector 61 are connected in parallel to receive the filtered and amplified signal of the receiver of the magnetic interrogation system. The modules 52, 54, and 56 are so connected to corresponding thresholds that the modules dedicated to positive pulses are connected to the positive threshold detector 59 while the module dedicated to the negative pulse is connected to the negative threshold detector 61. The modules are severally responsive to the output of the threshold detectors 59, 61 to enable as well as disable the succeeding stages in dependence on whether or not the pulse corresponding to the prior stage module is within its expected bounds. The modules reset themselves whenever the corresponding pulse for that module passes away.

Each of the modules 52, 54, 56 includes a minimum pulse width detector 60, 62, 64 and a maximum pulse width detector 66, 68, and 70 connected to receive the output of the corresponding positive or negative threshold detector 59, 61. The minimum and maximum pulse width detector pairs 60, 66; 62, 68; and 64, 70 of the modules 52, 54, and 56 respectively are selected to conform to the expected duration time and magnitude characteristics of the corresponding constitutive pulses of the expected pulse train. Only the correct polarity sequence of pulses above a preselected threshold that exist within carefully defined time durational windows are passed through by the pulse train processor, while all other pulse signal kinds and types are rejected thereby as undesirable noise.

Inverters 72, 74, and 76 are respectively connected to the output of the positive threshold detector 59, the output of the negative threshold detector 61, and the output of the positive threshold detector 59. The output of the inverters 72, 74 and 76 are respectively connected to the reset inputs of the minimum and maximum pulse-width detector pairs 60, 66; 62, 68; and 64, 70 of the pulse processing modules 52, 54, and 64. The inverters are respectively responsive to the falling edge of the pulse output of the corresponding threshold detectors 59, 61 for resetting, at the trailing edge of each pulse, the pulse processing module associated with the respective inverters. The several pulse processing modules, insofar as the minimum and maximum pulse-width detectors associated therewith are reset by the trailing edge of the pulses analysed thereby, are substantially continuously armed.

An enable gate 78 is connected between the output of the minimum pulse-width detector 60 of the initial pulse processing module 52 and the enable input of both of the minimum and of the maximum pulse-width detectors 62, 68 of the downstream pulse processing module 54. An enable gate 80 is connected to the output of the minimum pulse-width detector 62 of the pulse processing module 54 and the enable input of both the minimum and the maximum pulse-width detectors 64, 70 of the pulse processing module 56.

The gates 78, 80 are toggled to logic "1" provided the pulses analysed in the modules 52, 54 satisfy preselected minimum duration conditions. In the logic "1" state, the gates 78, 80 enable the downstream modules 54, 56, and in such a way that the initial module enables the intermediate module 54, and thereafter the intermediate module enables the downstream module 56, and so on time sequentially, in dependence on receiving a pulse train having the proper pulse polarity sequence the constitutive pulses of which having the proper minimum durations.

The minimum pulse-width detector 60 of the initial module 52 is always enabled, and is responsive to detection of a positive pulse beyond the threshold established by the threshold detector 59 that subsists for at least a specified minimum time to set the enable gate 78. The enable gate 78 is driven to the logic "1" state thereby, and enables the detectors 62, 68 of the intermediate module 54. If a neagtive polarity pulse of the requisite height is received in immediate temporal sequence, the detectors 62, 68, already in the enabled condition, are thereby able to respond to the duration of the negative pulse of the pulse train. If the negative polarity pulse is timely and is of a duration that matches the minimum duration expected for that pulse, the minimum pulse width detector 62 of the module 54 sets the enable gate 80. The gate 80 is driven to the logical "1" state, which in turn enables the detectors 64, 70 of the module 56. If a positive polarity pulse is then received of at least the threshold expected by the positive threshold detector 59, the minimum pulse-width detector 64, already in the enabled condition is able to determine whether or not it satisfies the minimum duration condition expected for that pulse. If it does, a trigger signal is output therefrom to the monostable multivibrator 81 via an OR gate 82. The OR gate 82 also receives the trigger output signal from the terminal module of the "negative, positive, negative" pulse train processor 58.

One input of an OR gate 84 is connected to the output of the inverter 74, and another input of the OR gate 84 is connected to the output of the maximum pulse-width detector 66 of the processing module 52. The output of the OR gate 84 is connected in parallel to the reset input of the enable gate 78 and to the reset inputs of the minimum and of the maximum pulse-width detectors 62, 68 of the pulse processing module 54. One input of an OR gate 86 is connected to the output of the inverter 76, and another input thereof is connected to the output of the maximum pulse-width detector 68 of the module 54. The output of the OR gate 86 is connected in parallel to the reset input of the enable gate 80 and to the reset inputs of the minimum and maximum pulse width detectors 64, 70 of the pulse processing module 56.

An OR gate 87 is connected between the detector 70 of the module 56 and the reset input of the vibrator 81.

The OR gates 84, 86 are operative, on the one hand, to pass through the output pulses of the associated inverters to reset the detectors 62, 68 and the detectors 64, 70 of the modules 54, 56 after the perishing of the corresponding pulse. The OR gates 84, 86 are further responsive to the same condition, that is to the occurrence of the trailing edge of the corresponding pulse, to reset the enable gate 78, and the enable gate 80. The gates 78, 80 are thereby toggled to the binary "0" state, and must await the occurrence of the appropriate duration and polarity pulse.

The OR gates 84, 86 are responsive to an output from the maximum pulse-width detector 66 and to an output from the maximum pulse-width detector 68 of the modules 52, 54 for resetting the enable gate 78 and minimum and maximum detectors 62, 68 of the module 54, and for resetting the enable gate 80 and the minimum and maximum detectors 64, 70 of the module 56. The detectors of the several modules as well as their associated enabling gates are thereby reset in the event that the pulse associated with the corresponding upstream module endures for a time period longer than the expected time period.

Figure 3:
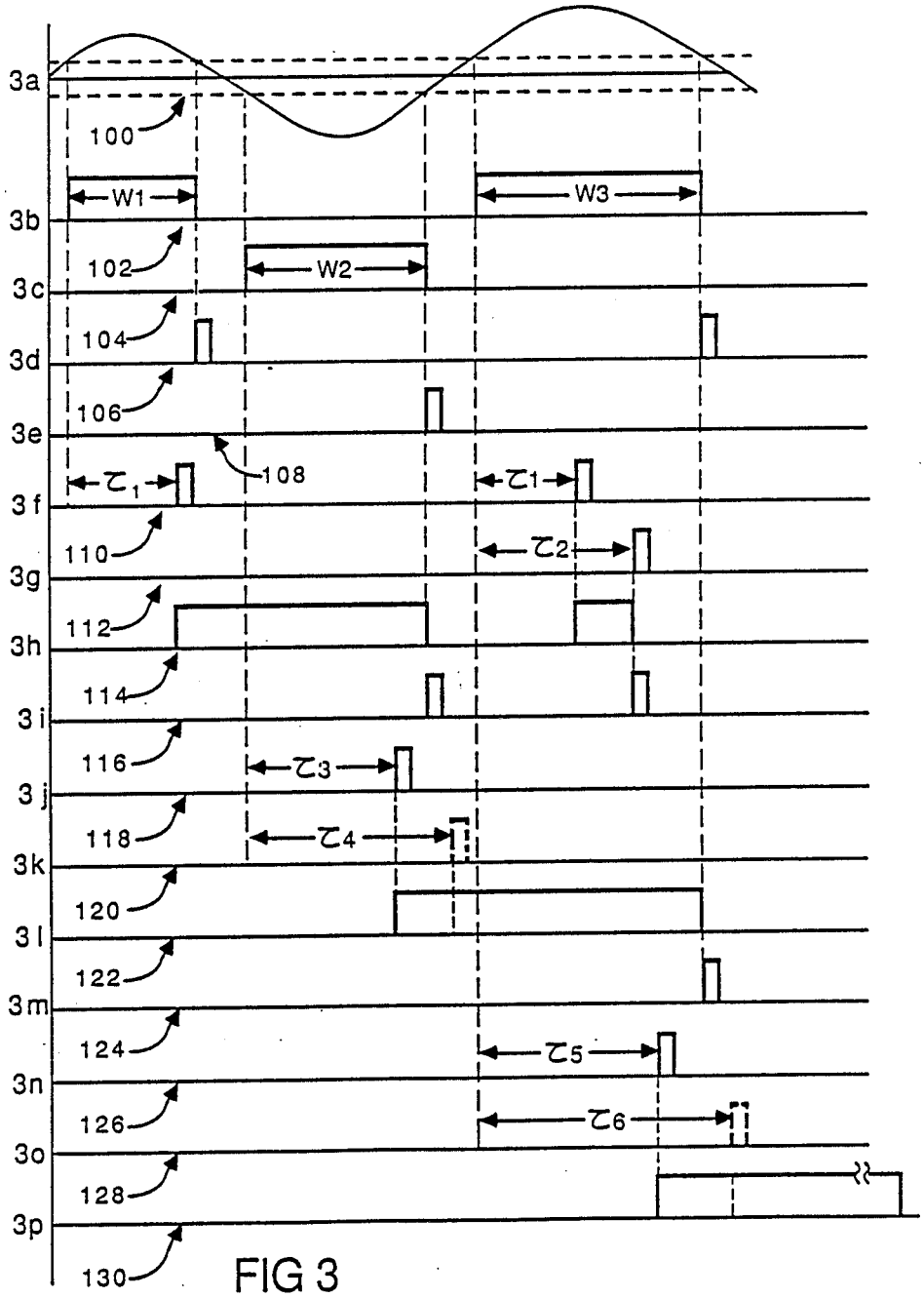
FIG. 3 illustrates in FIGS. 3-A through 3-P thereof timing diagrams useful in explaining the operation of the pulse train processor of FIGS. 1 and 2.

Referring now to FIG. 3, generaly designated at 100 in FIG. 3-A thereof is a graph illustrating a typical "tag" signal for an exemplary resonant tuned circuit system consisting of a pulse train having a positive polarity, a negative polarity, and a positive polarity pulse.

A curve generally designated 102 in FIG. 3-B illustates the positive pulses having the widths designated "W-1", "W-3" produced by the positive threshold detector 59 (FIG. 2) as the pulse train 100 is delivered thereto. The leading and trailing edges defining the widths of the pulses are delimited respectively at the times when the positive pulses of the pulse train exceed and fall below the preselected threshold as selectably provided therefor by the positive threshold detector.

As shown by a graph generally designated 104 in FIG. 3-C, a pulse having a width designated "W-2" is provided by the negative threshold detector 61 (FIG. 2), and in such a way that the duration thereof is delimited by the negative threshold level selected for the negative threshold detector.

As shown by a graph generally designated 106 in FIG. 3-D, pulses are produced at the trailing edge of the pulses illustrated by the graph 102 in FIG. 3-B by the inverters 74, 76 (FIG. 2) coupled to receive the output signal of the positive threshold detector, and as shown by a graph 108 in FIG. 3-E, a pulse is produced at the trailing edge of the output signal of the negative threshold detector 62 (FIG. 2) as the corresponding pulse falls below the preselected threshold.

As shown by a graph generally designated 110 in FIG. 3-F, pulses are produced by the pulse-width detector 60 (FIG. 2) of the initial pulse processing module 52 (FIG. 2) as soon as the duration of the pulse corresponding thereto exceeds the minimum duration selected for that pulse processing module. The minimum duration is designated as "$tau_1$" in FIG. 3-F. It should be noted that the third pulse of the pulse train illustrated in FIG. 3-A likewise produces a pulse out of the minimum pulse detector 52, (FIG. 2) as the pulse train is fed to the several modules in parallel.

As shown by a graph generally designated 112 in FIG. 3-G, a pulse is produced by the maximum pulse-width detector 66 of the module 52 (FIG. 2) upon the pulse exceeding the maximum duration conditions prescribed for the pulse corresponding to the first pulse processing module. As appears below, the output of the maximum pulse-width detector resets the downstream module, thereby preventing a false alarm.

As shown by a graph generally designated 114 in FIG. 3-H, the gate 78 (FIG. 2) is toggled to the logical "1" state with the rising edge of the first pulse illustrated in the graph 110 of FIG. 3-F. The gate signal is toggled to the logical "0" condition upon the occurrence of the leading edge of the negative pulse signal illustrated by the graph 108 in FIG. 3-E. The enable gate 78 (FIG. 2) as illustrated by the second pulse of the graph 114 is toggled to the logical "1" state upon the leading edge of the second pulse of the graph 110 in FIG. 3-F representative of the third pulse of the pulse chain exceeding the minimum condition for duration prescribed for the first pulse. The gate is toggled to the logical "0" state by the leading edge of the output pulse of the maximum pulse-width detector illustrated by the graph 112 in FIG. 3-G.

As shown by a graph 116 in FIG. 3-I, the enable gate 78 (FIG. 2) is reset by the output of the OR gate 84, (FIG. 2) which output is produced either by the termination of the negative pulse, represented by the first pulse of the graph 116, or by the timing out of the maximum pulse-width detector 66 of the module 52 (FIG. 3).

As shown by a graph 118 in FIG. 3-J, the minimum detector 62 of the module 54 produces a pulse after a specified minimum time duration after the beginning of the pulse produced by the negative threshold detector as can be seen by comparing the graph 104 of FIG. 3-C.

As shown by a graph 120 in FIG. 3-K, the maximum pulse-width detector of the intermediate module provides an output pulse after a preselected time interval designated "$tau_4$" from the beginning of the pulse produced by the negative threshold detector.

As shown by a graph generally designated 122 in FIG. 3-L, the enable gate of the third and final processing module in the illustrated embodiment is toggled to the logical "1" state in response to the occurrence of the output pulse of the upstream minimum pulse-width detector, as best seen by comparing graph 118 of FIG. 3-J. The enable gate for the terminal module is toggled to the logical "0" state in response to the trailing edge of the third constitutive pulse of the pulse train as can be seen by comparing the second pulse of the graph 102 of FIG. 3-B.

The reset for the enable gate is illustrated by the graph generally designated 124 in FIG. 3-M.

As illustrated by a graph generally designated 126 in FIG. 3-N, the minimum pulse-width detector of the terminal module of the pulse train processor produces a pulse upon the corresponding pulse of the pulse train satisfying a duration condition designated "$tau_5$" specified therefor.

As shown by a graph generally designated 128 in FIG. 3-O, the maximum pulse-width detector of the third processing module provides a pulse at a time when the corresponding pulse of the pulse train subsists for a time as long as the maximum time specified for that pulse and designated by an interval "$tau_6$". The pulse is illustrated in dashed outline for reasons that appear immediately below.

As shown by a graph generally designated 130 in FIG. 3-P, the minimum pulse-width signal represented as the pulse in the graph 126 of FIG. 3-N triggers the monostable multivibrator 81 (FIG. 1). The monostable multivibrator is retriggerable, and would be retriggered in the event that the pulse persists for a time longer than the prescribed time. In that event, the multivibrator would be reset, and a failure of alarm condition would thereby be prevented.

Figure 4:
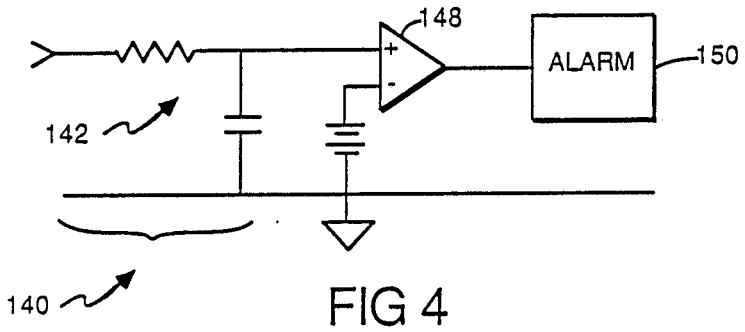
FIG. 4 is a schematic diagram illustrating the integrating and threshold circuit of FIG. 1.
Figure 5:
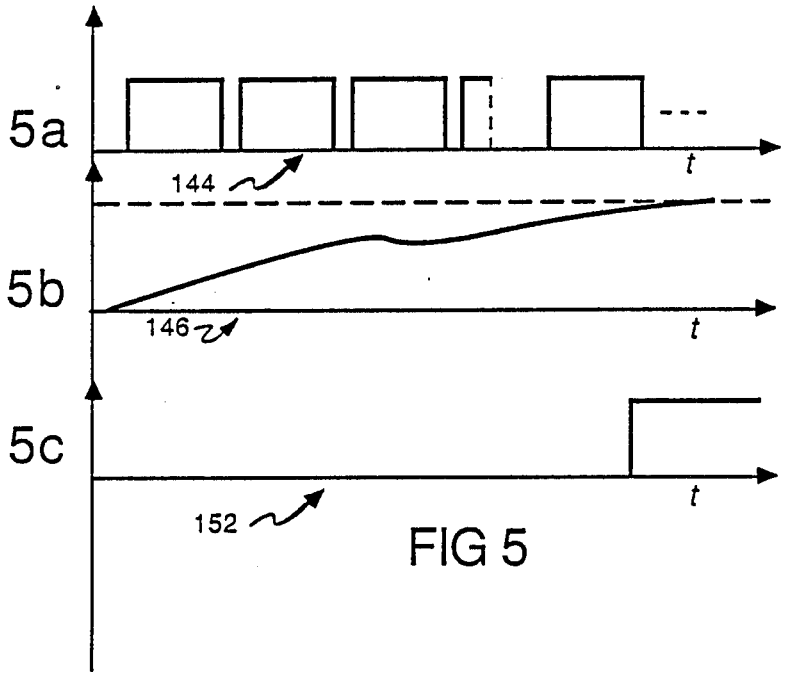
FIG. 5 is a timing diagram useful in explaining the operation of the FIG. 4 circuitry.

Referring now to FIG. 4, generally designated at 140 is a schematic circuit diagram illustrating the integration and averaging circuit of the present invention. The pulse output stream provided by the retriggerable monostable multivibrator is integrated in an R, C network generally designated 142. As illustrated by a graph generally designated 144 in FIG. 5-A, the input signal applied to the integrator 142 is the output of the monostable multivibrator. The output pulses are integrated by the integrator 142 producing a potential that rises with each pulse output of the monostable multivibrator as shown by a graph generally designated 146 in FIG. 5-B. The integrated signal is applied to a threshold comparator 148. The comparator provides an output signal to an alarm 150 if the magnitude of the integrated signal potential exceeds the selected threshold of the comparator 148 as illustrated by the dashed line in FIG. 5-B, and, thereafter, an alarm is signaled by a graph generally designated 152 in FIG. 5-C.

Many modifications of the presently disclosed invention will become apparent to those skilled in the art without departing from the inventive concept.

What is claimed is:

1. A continuously armed pulse train processor for a field disturbance sensor, comprising:

means for providing a pulse train of constitutive consecutive pulses in response to a magnetic tag being present in an interrogation zone of the field disturbance sensor;

resetable means coupled to the pulse train providing means for sequentially determining whether the several constitutive pulses serially meet predetermined minimum and maximum temporal duration criteria established therefor; and means cooperative with the resetable means and responsive to a failure of any pulse of the pulse train to meet the corresponding criteria for resetting the resetable means such that the resetable means is again able to sequentially determine ab initio whether sequentially received pulse train pulses serially received after the resetting of the resetable means meet the predetermined pulse train criteria therefor.

2. The pulse train processor of claim 1, wherein said resetable means includes an array of enablable pulse processing module means each receiving the pulse train, each module means for detecting the expected minimum and maximum duration criteria of a different one of the constitutive pulses of the pulse train.

3. The pulse train processor of claim 2, wherein said resetable means includes enablable gates serially connected between initial and last ones of the pulse processing module means defining thereby upstream and downstream pulse processing module means, said gates operative to enable downstream mdoule means if and only in response to upstream module means detecting the predetermined pulse criteria corresponding thereto, said gates being further operative to disable downstream module means both in response to termination of the pulse corresponding to that module means and in response to the upstream module means detecting that the pulse characteristics corresponding to that pulse exceed the maximum duration criteria prescribed therefor.

4. The pulse train processor of claim 3, wherein the gates are flip-flops that have selectable logical states, the flip-flops accomplish the enabling of downstream module means and accomplish the disabling thereof in accordance with which of the logical states the flip-flops are in.

5. The pulse train processor of claim 1, wherein said minimum and maximum temporal duration criteria are implemented with dedicated pulse width detectors.

6. A continuously armed pulse train processor for a swept radio frequency sensor, comprising:

means for providing a pulse train of constitutive consecutive pulses in response to a resonant tag being present in an interrogation zone of the swept radio frequency sensor;

resetable means coupled to the pulse train providing means for sequentially determining whether the several constitutive pulses serially meet predetermined minimum and maximum temporal duration criteria established therefor; and means cooperative with the resetable means and responsive to a failure of any pulse of the pulse train to meet the corresponding criteria for resetting the resetable means such that the resetable means is again able to sequentially determine ab initio whether sequentially received pulse train pulses serially received after the resetting of the resetable means meet the predetermined pulse train criteria therefor.

7. The pulse train processor of claim 6, wherein said resetable means includes an array of enablable pulse processing module means each receiving the pulse train, each module means for detecting the expected minimum and maximum duration criteria of a different one of the constitutive pulses of the pulse train.

8. The pulse train processor of claim 7, wherein said resetable means includes enable gates serially connected between initial and last ones of the pulse processing module means defining thereby upstream and downstream pulse processing module means, said gates operative to enable downstream module means if and only in response to the upstream module means detecting the predetermined pulse criteria corresponding thereto, said gates being further operative to disable downstream module means both in response to termination of the pulse corresponding to that module means and in response to the upstream module means detecting that the pulse characteristics corresponding to that pulse exceed the maximum duration criteria prescribed therefor.

9. The pulse train processor of claim 8, wherein the gates are flip-flops that have selectable logical states, the flip-flops accomplish the enabling of downstream module means and accomplish the disabling thereof in accordance with which of the logical states the flip-flops are in.

10. The pulse train processor of claim 6, wherein said minimum and maximum temporal criteria are implemented with dedicated pulse width detectors.

11. A pulse-train processor for discriminating a pulse-train provided by a true target from noise provided by a false target, comprising:

receiver means having a field of view for providing a pulse-train signal having n constitutive pulses in response to a target being in the field of view, where n is an integer greater than or equal to 2;

a like plurality of n resetable pulse processing module means coupled in parallel to the receiver means respectively for discriminating corresponding pulses of said n pulses constituting said pulse train signal with respect to whether or not individual constitutive pulses of said pulse-train signal satisfy predetermined expected first criteria associated with each of the pulses of the pulse-train signal;

sequencing means coupled to said plural pulse processing modules for enabling a kth module means of said n pulse processing module means to discriminate a kth pulse corresponding thereto in response to the $k-1$ module means having already discriminated that the corresponding $k-1$ pulse satisfied its associated first criteria and for disabling the enabled kth module in response to decay of the kth pulse for every module means except a first module means which is always enabled, where k is an integer greater than 1 and less than or equal to n; and means cooperative with the sequencing means and coupled to said pulse processing module means for resetting the kth module means if the $k-1$ pulse of the pulse-train signal satisfies a second predetermined criteria different from the first predetermined criteria for each module means.

12. The pulse-train processor of claim 11, wherein said first criteria includes minimum temporal duration of a minimum height pulse.

13. The pulse-train processor of claim 12, wherein said first criteria is implemented using a threshold detector and an associated minimum pulse-width detector.

14. The pulse-train processor of claim 11, wherein said sequencing means includes logic means serially interconnecting said n module means into electrically adjacent upstream and downstream module means.

15. The pulse-train processor of claim 14, wherein said logic means include a binary gate toggled to one logical state in response to the upstream module means having already discriminated the first criteria corresponding to its associated pulse and toggled to the other logical state in response to the trailing edge of the pulse of the upstream module with the exception of the first module.

16. The pulse-train processor of claim 15, wherein said resetting means includes second logic means coupled to said gate means for toggling the gate means to the logical state the gate is toggled to in response to the trailing edge of the pulse corresponding to each upstream module.

17. The pulse-train processor of claim 11, wherein said second criteria includes a maximum temporal duration.

18. The pulse-train processor of claim 17, wherein said maximum temporal duration criteria is implemented with a maximum pulse-width detector.

19. The pulse train processor of claim 11, wherein said field of view is provided by a field disturbance sensor.

20. The pulse train processor of claim 11, wherein said field of view is provided by a swept radio frequency sensor.

21. For use in an electronic theft prevention system which includes transmitter means for providing a field within a predetermined interrogation zone, receiving means for monitoring the field of the interrogation zone and for detecting the presence of a target in the interrogation zone and for providing a pulse train representative of target presence in the interrogation zone, a pulse train processor for discriminating a pulse train provided by a true target from noise provided by a false target, said processor comprising;

a plurality of pulse detection modules each operative to simultaneously receive the pulse train, the plurality of pulse detection modules including a first module, one or more intermediate modules and a last module;

the first module being operative to receive the first pulse of the pulse train and upon recognition of predetermined valid characteristics of that first pulse to enable the next intermediate module;

each of the intermediate modules being operative to receive respective successive pulses of the pulse train and each being operative upon recognition of predetermined valid characteristics of the successive received pulses to enable the next intermediate or the last module;

the final module being operative to receive the next successive pulse of the pulse train and upon recognition of predetermined valid characteristics of that received pulse to provide a trigger pulse output signal;

means of accumulating the trigger pulses from the last module;

means for providing an output alarm signal in response to the accumulation of a predetermined number of trigger pulses.

22. The invention of claim 21, wherein the means for accumulating includes:

multi-vibrator means operative in response to the trigger pulses to provide multivibrator output pulses;

integrating means operative in response to the multivibrator output pulses to provide an integration signal;

threshold means for providing a predetermined threshold level;

means for providing said alarm output signal in response to exceedence of the threshold level by the integration signal.

23. The invention of claim 22, wherein the first and intermediate modules are each operative in response to a pulse width greater than a predetermined maximum width to reset the succeeding module;

and wherein said last module is operative in response to a pulse width greater than the predetermined maximum width to reset said monostable multivibrator means.

24. The invention of claim 21, wherein positive and negative threshold detectors are operatively coupled to said plurality of pulse detection modules in such a way that selected modules respond to positive polarity pulses and selected other ones of the modules respond to negative polarity pulses.

25. The invention of claim 21, wherein said modules are operative in response to pulse decay of the received pulse train to reset themselves.

26. The invention of claim 25, wherein said modules each include resetable timers for setting minimum and maximum durational valid characteristics of the pulses, and wherein said pulse decay allows the timers to restart.

27. The invention of claim 21, wherein none of the said pulse detection modules are operative if the received pulses do not have a minimum pulse width.

* * * * *

UNITED STATES PATENT AND TRADEMARK OFFICE

CERTIFICATE OF CORRECTION

PATENT NO. : 4,779,077

DATED : October 18, 1988

INVENTOR(S) : George J. Lichtblau

It is certified that error appears in the above-identified patent and that said Letters Patent is hereby corrected as shown below:

Column 3, line 9, "later," should read --latter,--

Column 5, line 19, "64." should read --56.--

Column 5, line 57, "neagtive" should read --negative--

Column 9, line 15, "mdoule" should read --module--

Signed and Sealed this

Twenty-sixth Day of September, 1989

*Attest:*

DONALD J. QUIGG

*Attesting Officer*

*Commissioner of Patents and Trademarks*